US008172694B2

(12) United States Patent
Golden et al.

(10) Patent No.: US 8,172,694 B2
(45) Date of Patent: May 8, 2012

(54) GOLF CLUB HEAD COMPRISING A PIEZOELECTRIC SENSOR

(75) Inventors: Charles Edward Golden, Encinitas, CA (US); Peter J. Gilbert, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 11/979,787

(22) Filed: Nov. 8, 2007

(65) Prior Publication Data

US 2009/0120197 A1 May 14, 2009

(51) Int. Cl.
*A63B 57/00* (2006.01)

(52) U.S. Cl. ..... 473/223; 73/65.03

(58) Field of Classification Search ..... 73/65.03; 473/223, 233, 131, 226
See application file for complete search history.

(56) References Cited

U.S. PATENT DOCUMENTS

| | | | | |
|---|---|---|---|---|
| 3,270,564 | A | 9/1966 | Evans | 73/865.4 |
| 3,792,863 | A * | 2/1974 | Evans | 473/223 |
| 3,945,646 | A * | 3/1976 | Hammond | 473/223 |
| 4,088,324 | A * | 5/1978 | Farmer | 473/223 |
| 4,928,965 | A * | 5/1990 | Yamaguchi et al. | 473/332 |
| 6,196,932 | B1 * | 3/2001 | Marsh et al. | 473/223 |
| 2002/0173364 | A1 * | 11/2002 | Boscha | 473/131 |
| 2005/0037862 | A1 | 2/2005 | Hagood et al. | |

FOREIGN PATENT DOCUMENTS

JP 07155416 A * 6/1995

OTHER PUBLICATIONS

Vernon D. Barger, "Rigid-body dynamics", in AccessScience@McGraw-Hill, Accessed online at <http://www.accessscience.com, DOI 10.1036/1097-8542.590400>. Accessed online on Nov. 19, 2009.*

Hocknell, A., Jones, R., Rotheberg, S., "Experimental analysis of impacts with large elastic deformation: I. Linear motion." Meas. Sci. Technol. 7 (1996) 1247-1254.*

Fitzpatrick, K. and Anderson, R., Validation of accelerometers and gyroscopes to provide real-time kinematic data for golf analysis. The Engineering of Sport 6. (2006) 4 pp. 155-160.*

U.S. Appl. No. 11/524,304, filed Mar. 22, 2007 entitled "Golf Assessment and Improvement System".

U.S. Appl. No. 11/364,343, filed Sep. 6, 2007 entitled "IR System for Kinematic Analysis".

U.S. Appl. No. 10/915,804, filed Feb. 17, 2005 entitled "Method and Apparatus for Active Control of Golf Club Impact".

U.S. Appl. No. 10/898,367, filed Dec. 8, 2005 entitled "Launch Monitor".

(Continued)

*Primary Examiner* — Lisa Caputo
*Assistant Examiner* — Punam Roy
(74) *Attorney, Agent, or Firm* — Murphy & King, P.C.

(57) ABSTRACT

An apparatus and method for determining the kinematic characteristics of a golf club head are disclosed. The apparatus includes at least one piezoelectric component selectively positioned within or upon a club head. The piezoelectric component is preferably positioned to the rear of the center of gravity, and near the midpoint of the face of the club head. During a golf club swing, the piezoelectric component determines the acceleration and deceleration of the golf club head. When the club head impacts an object such as a golf ball, the piezoelectric component is also operable to determine the velocity of the club head. It may also be desirable for the piezoelectric component to determine the magnitude of vibration during impact. In this manner, the piezoelectric component may function determine the efficiency of a golf club swing.

20 Claims, 2 Drawing Sheets

OTHER PUBLICATIONS

U.S. Appl. No. 10/861,443, filed Dec. 8, 2005 entitled "Launch Monitor".
Non-Final Office Action dated Jun. 22, 2010 of corresponding U.S. Appl. No. 12/401,079.
Non-Final Office Action dated Jun. 22, 2010 of corresponding U.S. Appl. No. 12/401,102.
Non-Final Office Action dated Mar. 18, 2011 of corresponding U.S. Appl. No. 12/401,079.
Non-Final Office Action dated Mar. 21, 2011 of corresponding U.S. Appl. No. 12/401,102.
Notice of Allowance dated Oct. 26, 2011 of corresponding U.S. Appl. No. 12/401,079.
Notice of Allowance dated Dec. 19, 2011 of corresponding U.S. Appl. No. 12/401,102.
Final Office Action dated Jul. 15, 2011 of corresponding U.S. Appl. No. 12/401,102.

* cited by examiner

GOLF CLUB HEAD COMPRISING A PIEZOELECTRIC SENSOR

FIELD OF THE INVENTION

The present invention relates to measuring the kinematic characteristics of a golf club before, during, and after impacts with a golf ball. More specifically, the present invention relates to measuring the swing speed, impact efficiency, and acceleration of a golf club by using a piezoelectric device positioned within or upon the inner volume of a club head.

BACKGROUND OF THE INVENTION

The growing interest in the game of golf has spurred golf equipment manufacturers to increase the variety of equipment that they produce. Revolutions in computing and advances in material science have simultaneously allowed equipment manufacturers to meet the demands of consumers in ever more precise ways. Golf balls, for instance, are now manufactured specifically to give a golfer the right "feel" when the club face strikes the golf ball. Golf balls are also manufactured to fly farther by manipulating the patterns formed by the dimples on the surface of the golf ball. With respect to golf clubs, newer materials have allowed golf club designers to produce lighter and stronger golf clubs. Features of the golf clubs have also been varied to manipulate head characteristics, such as center of mass, face angle, and face texture.

Depending on the skill of the golfer, their playing style, and their personal preferences, specific equipment may be selected to assist the golfer in obtaining the optimal performance. In the past, a golf professional would assist a golfer in choosing their equipment either based on their body type, general information provided by the golfer about their style of play, and/or observing the golfer's swing with the naked eye. More recently, golf professionals have used devices referred to as "launch monitors" to observe a player's swing characteristics. By observing a golfer's swing with different clubs and balls, a launch monitor provides a golf professional with more information on which to base a club and/or ball recommendation.

A limitation of present methods and apparatus for measuring the kinematics of a golf club is that the measurements are taken by outside equipment. For instance, a launch monitor often acquires images of a golf club in motion and then determines the kinematic characteristics of the club based on those images. While the precision and accuracy of these devices is constantly improving, it is also desirable to obtain the kinematic characteristics of the golf club from the golf club itself. That is, a continuing need exists for a method and apparatus that allows a golf club to directly measure and relay the kinematic information of the golf club. Moreover, a continuing need exists for a golf club that has the ability to measure and relay its kinematic characteristics without being perceptible to a golfer.

SUMMARY OF THE INVENTION

According to one aspect, the present invention comprises an apparatus for measuring the kinematic characteristics of a golf club. The apparatus includes a golf club head that comprises an inner volume bounded by a face and a rear. A piezoelectric component is selectively positioned within the inner volume towards the rear of the center of gravity of the golf club head and on the back of the face of the golf club head. In one embodiment, the piezoelectric device comprises an accelerometer. It may be desirable for the apparatus to also include a display operatively connected to the piezoelectric component and configured and dimensioned to be part of the golf club head's surface.

According to this aspect, the present invention also includes a processor and a memory operatively connected to the piezoelectric component. To allow information to be transferred from the piezoelectric component to an outside processor, a wireless transmitter may also be utilized. In order to prevent a golfer from perceiving the piezoelectric component within the club head, it is preferably secured in a desired portion of the inner volume of the club head using a fastener.

The piezoelectric component is operable to determine several kinematic characteristics, such as the velocity of the golf club head at impact with an object, e.g., a golf ball. In addition, the magnitude of vibration generated during impact with an object, and the linear and rotational acceleration and deceleration of the golf club head may also be determined.

According to another aspect, the present invention comprises an apparatus for measuring the kinematics of a golf club head. The apparatus includes a golf club head comprising an inner volume formed by a face and a rear. At least two piezoelectric components are selectively positioned within the inner volume of the golf club head such that they are positioned towards the rear of the golf club head. Preferably, a first of the at least two piezoelectric components is positioned substantially midway between the heel and a midpoint of the face of the golf club head, and the second of the at least two piezoelectric components is positioned substantially midway between the midpoint of the face and the toe of the golf club head. Optionally, the at least two piezoelectric components, which may be operatively connected to one another, are positioned towards the rear of the center of gravity of the club head.

Finally, according to a third aspect of the present invention, a method for measuring the kinematic characteristics of a golf club is disclosed. The method includes selectively positioning an accelerometer within the inner volume of a golf club head. Then, the kinematic characteristics of the golf club head during motion are acquired using the accelerometer. After the kinematic characteristics are acquired, they are preferably displayed.

BRIEF DESCRIPTION OF THE DRAWINGS

Further features and advantages of the invention can be ascertained from the following detailed description that is provided in connection with the drawings described below.

DETAILED DESCRIPTION OF THE PREFERRED EMBODIMENTS

Figure 1:
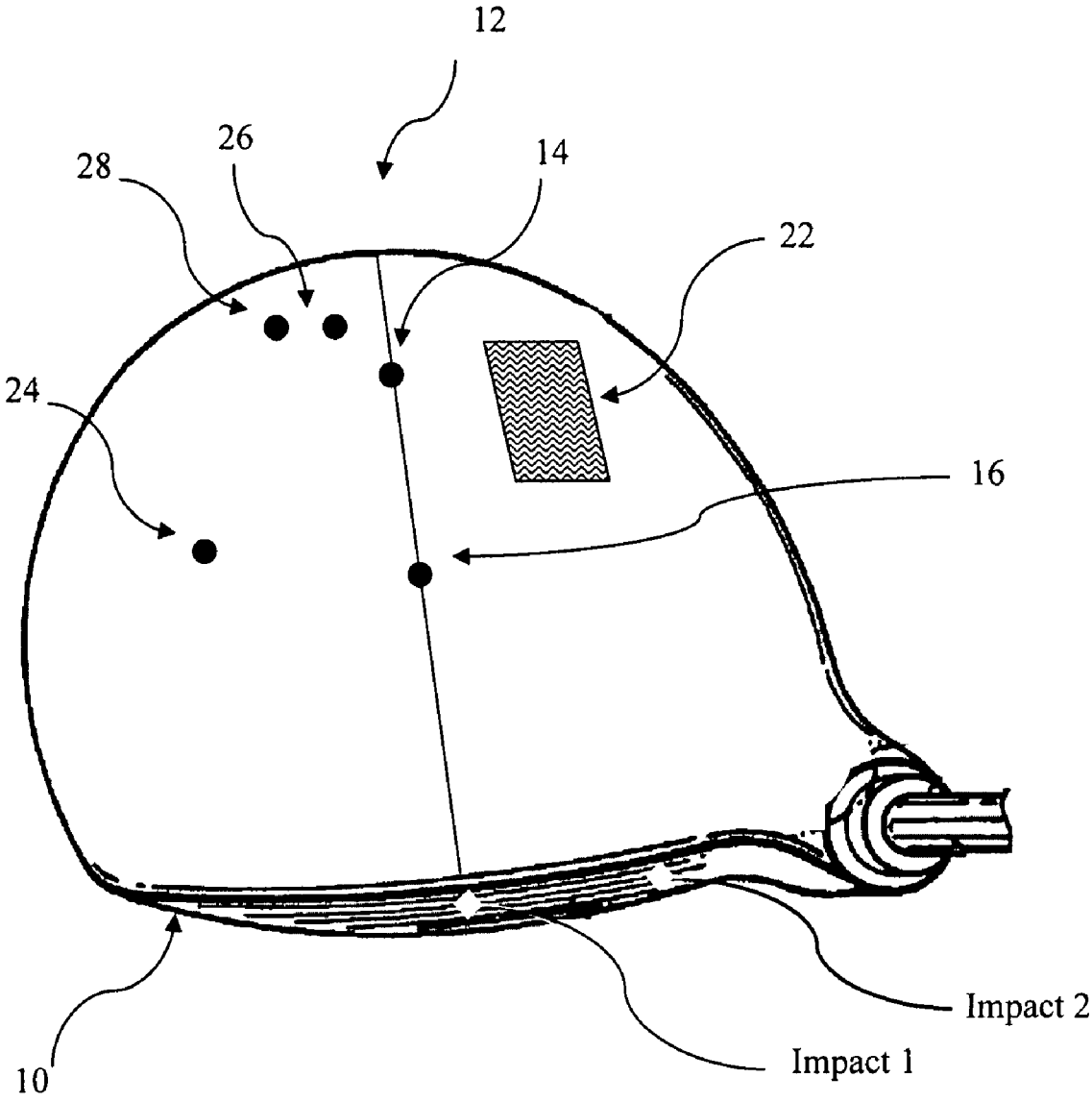
FIG. 1 shows a first exemplary embodiment of the golf club head of the present invention.

The determination of swing speed, impact efficiency, and acceleration can assist a golfer in correcting his/her swing and generally improving his/her golf game. One embodiment of the present invention allows these and other kinematic characteristics to be determined by including at least one piezoelectric component in the head of the golf club. Preferably, the at least one piezoelectric component is selectively positioned towards the rear of the inner volume of the club head. More preferably, it is also desirable for the piezoelectric component to be positioned far enough towards the rear or the club head that it is behind the club head's center of gravity. In a preferred configuration, the piezoelectric component is also positioned approximately near the middle of the face of the club head.

According to one aspect, the present invention may be used with any type of golf club. Skilled artisans will recognize that the present invention is not intended to be limited to any particular type of golf club, golf club head, or golf club components. Any type of golf club, including woods, irons, drivers, putters, wedges, and the like may be used. The golf club may also comprise any type of shaft or handle known to those skilled in the art. Any material or combination of materials may also be used, including but are not limited to, metal, wood, alloys, composites, plastic, and rubber. If the club head defines an internal volume, the measuring devices(s) may be positioned within the defined volume. Alternatively, the measuring device(s) may be positioned on an external portion of the club head.

In one embodiment, the piezoelectric device preferably comprises an accelerometer that measures the impact of an object. The accelerometer is operable to measure both the static acceleration of the club head using the Earth's gravity, and the shock or vibration from an impact. Though any piezoelectric device or accelerometer known to those skilled in the art maybe used, one example of an accelerometer that may be used is manufactured by Freescale Semiconductor, Inc. The accelerometer may be powered by any desirable power source. Of course, it is desirable for the power source to have a minimum weight and size necessary to power the accelerometer for a desired amount of time, as it is required to fit within the inner volume of the club head without perceptibly impacting the weight of the club. Preferably, the power source provides power to the microcontroller for at least about 2 hours or more. More preferably, the power source provides power to the accelerometer for at least 4 hours or more, and most preferably the power source provides power to the accelerometer for at least 6 hours or more.

As conservation of power is typically a consideration in any mobile application, it is desirable for the present invention to conserve power when possible. In particular, it may be desirable for the power supply to automatically shut down when the club is not in use. For instance, if the club has not moved for a predetermined period of time, a processor (described below) may determine that the club is not in use. When this determination is made, the processor may shut down the power source until it is determined that the club is being used again. Alternately, the power source may go into a "sleep-mode" that allows it to stay on while conserving power. Alternately, the golf club head may include a power switch that allows a golfer to manually turn the power source on and off.

In one embodiment, the power source is preferably rechargeable and can be recharged in a variety of manners known to those skilled in the art. For instance, the power source may be positioned such that is may be removed from the golf club head and inserted into a charging device. Alternately, the golf club head may have a port that is operatively connectable to a power supply that can recharge the battery. In other embodiments, the power source may be wirelessly rechargeable, through induction or the like. In some embodiments the power source may not be rechargeable. In such an embodiment, positioning the power source such that it can be removed from the club head allows it to be easily interchangeable.

In order to allow information to be recorded, a memory 26 is operatively connected to the accelerometer. Any type of memory 26 may be used as desired including, but not limited to, random access memory (RAM), read-only memory (ROM), flash memory, erasable programmable read-only memory (EPROM), electrically erasable programmable read-only memory (EEPROM), or combinations thereof. The memory 26 is operable to store the kinematic information for a desired period of time. Also included is a processing device 28, such as a microcontroller. The processing device 28 may be operatively connected to at least one of the memory 26, power source, or accelerometer 14.

It is also desirable for the information acquired by the present invention to be displayed so that a golfer can analyze the kinematic characteristics of their performance. One way to display the information measured and recorded by the accelerometer is to operatively connect a display 22 (FIG. 1), such as an LCD, LED, or other type of display to the accelerometer. In this embodiment, the display is selectively positioned away from the striking surface of the club, e.g., the face of the club. The display may be configured and dimensioned such that it does not obstruct or otherwise affect the movement of the club. It may be desirable to employ a flexible, flat display, such as those developed and manufactured by companies such as Lucent, DuPont, 3M, and Phillips. Using a flexible display allows the display to follow the natural contour of the club head while still allowing a golfer to view the desired information.

In one embodiment, the display may be configured and dimensioned such that it forms a portion of the golf club head's outer surface, such as the skirt or perimeter of the golf club. Alternately, the display may be positioned on top of a portion of the golf club head. If such a configuration is selected, it is desirable for the display to be adapted such that it does not appreciably affect the aerodynamic qualities of the golf club head. One way that this may be achieved is to secure the display to the golf club head, and then provide a transparent coating or layer over the display to hold it in place. Other methods and/or apparatus known to skilled artisans may also be used to minimize the display's effect on the aerodynamic qualities of the club head.

Another way to display the information measured and recorded is to include a wireless transmitter 24 that is operatively connected to the accelerometer. The wireless transmitter 24 may be positioned within the inner cavity of the club head, within the inner cavity of the club shaft, or otherwise. The weight of the wireless transmitter 24 is preferably minimized such that it has a negligible effect on the overall weight, or weight distribution, of the golf club. In another embodiment, the information obtained and stored by the present invention may be uploaded to another processor, e.g., a computer, though a manual connection, e.g., a universal service bus (USB) connection. The connection may be selectively positioned on any part of the golf club head, or shaft, however it is preferably placed away from the striking surface of the club, e.g., the face.

It is preferable for the present invention to be positioned, configured, and dimensioned such that it measures the kinematic characteristics of the golf club without being perceived by a golfer. Along these lines, the accelerometer is preferably fastened to at least a portion of the inner volume of the club head. The accelerometer may be fastened to the inner volume of the club head using any method or apparatus known to those skilled in the art, such as glue, epoxy, resin, or mechanical fasteners. For instance, according to one aspect of the invention the accelerometer is fastened to the inner volume of the club head using an insert placed inside the club head. The insert may be comprised of any material, such as urethane or the like. Preferably, the weight of the material used to fasten the accelerometer to the inner volume of the club head is minimized so that its effect on the overall weight and weight distribution of the club head is reduced.

Any number of accelerometers may be used as desired. As shown in FIG. 1, one accelerometer may be selectively positioned within the inner volume of the club head. The accelerometer is preferably positioned near the midpoint of the face 10 and towards the rear 12 of the club head. It is also desirable for the accelerometer 14 to be positioned to the rear 12 of the center of gravity 16, e.g., between the center of gravity 16 and the rear 12 of the club head. When positioned in this manner, the accelerometer 14 is operable to measure the forces generated by an impact of the club head with a golf ball. If the club head strikes the golf ball in the center of the face (impact 1), the accelerometer 14 will measure only a single force component that is perpendicular to the face 10 because the accelerometer 14 is also positioned at the center of the face. However, when the club head strikes the golf ball off center (impact 2), the accelerometer's 14 position at the center of the club face allows it to measure the various components of the force, e.g., a "side" force, that is generated by the impact.

Figure 2:
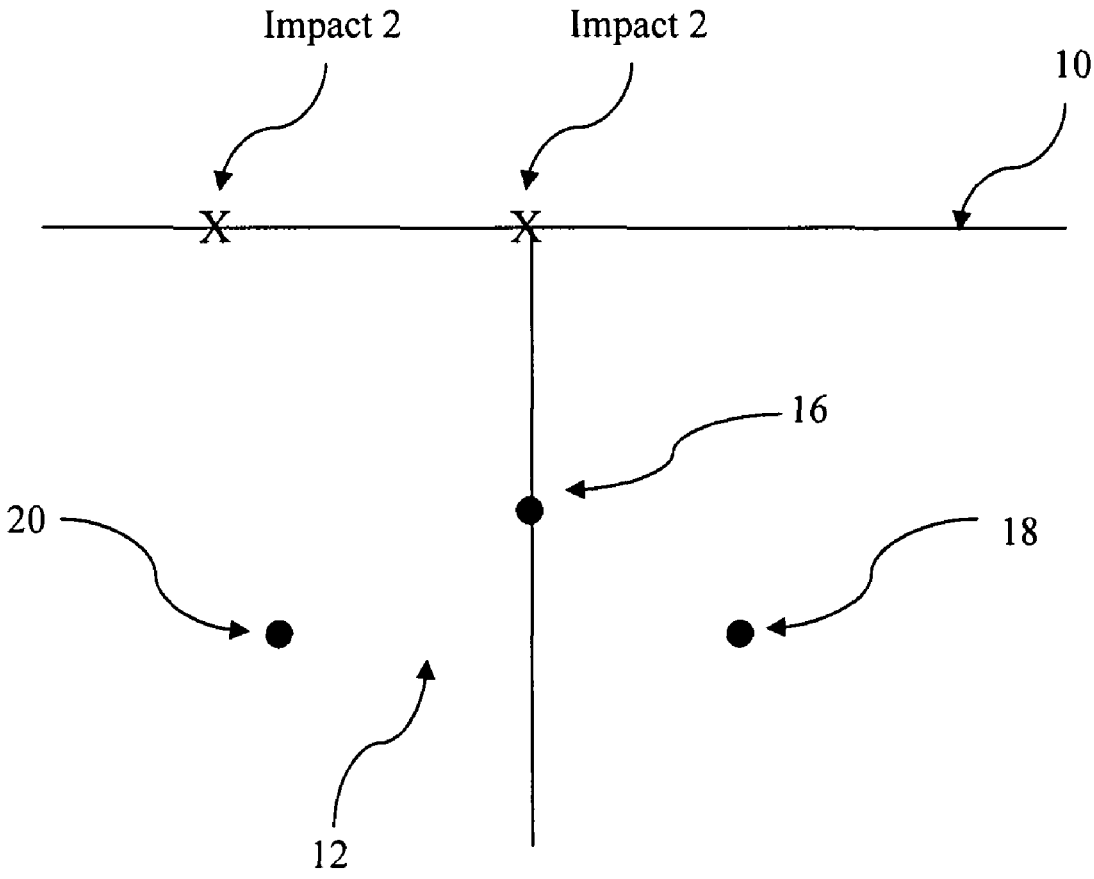
FIG. 2 shows a second exemplary embodiment of the golf club head of the present invention.

In an alternate embodiment, the present invention may include two or more accelerometers 18, 20. As shown in the FIG. 2 embodiment, two accelerometers 18, 20 may also be positioned within the inner cavity of the club head. A first accelerometer 18 may be positioned between the midpoint of the face and the toe of the club, and the second accelerometer 20 may be positioned between the midpoint of the face and the heel of the club, as shown in FIG. 2. With respect to the center of gravity 16 and the rear 12 of the club, each accelerometer 18, 20 is positioned in a similar manner as described above with respect to the embodiment comprising a single accelerometer.

One advantage of using two or more accelerometers is that the forces generated at different parts of the club head may be measured. For example, if the club head strikes the ball off center (impact 2), as shown in FIG. 2, accelerometer 20 will measure only one force component that is substantially perpendicular to the face 10 of the club because this accelerometer is in line with the impact location on the face. Relative to the position of accelerometer 18, however, the impact will be off center, causing accelerometer 18 to record two or more force components based on the side force that is generated. Thus, one advantage of using two accelerometers 18, 20 is that the area of impact may be more accurately determined relative to the center of the face 10. Moreover, the force components at different parts of the club head may also be determined with a greater degree of accuracy.

Though it is preferable for the accelerometer to be positioned as described above, the other elements that are operatively connected to the accelerometer may be selectively positioned as desired. That is, elements such as the processor, display, and power supply may be positioned in different areas of the inner volume of the club head. When positioning the other elements, the overall weight distribution of the club head may be taken into account. In other words, the weight of the other elements can be distributed such that the club head has a desired weight distribution, e.g., more weight lower, rear of the club, beneficially positioning the club head center of gravity. Each of these elements may be secured to the inner volume of the club head in a similar manner as those described above with respect to the accelerometer.

The apparatus of the present invention enables a plurality of kinematic characteristics of the golf club to be determined. For example, the apparatus described above allows characteristics such as acceleration, deceleration, velocity at impact, and acceleration/deceleration through impact to be measured. The present invention is also operable to be used as an efficiency meter. In other words, an accelerometer may be positioned at the center of the club head. When the golf club strikes a golf ball off center, e.g., towards the toe or heel, the accelerometer will record a different signal than if the golf ball was struck at the center of the face. By measuring the amplitude and frequency content of vibration, the efficiency of the golf club swing may be determined.

A similar principle applies to embodiments that use two or more accelerometers. In the FIG. 2 embodiment, when the club head strikes a golf ball off center, closer to the heel, accelerometer 20 will measure a larger vibration than accelerometer 18. Similarly, when the club head strikes the golf ball off center, closer to the toe, accelerometer 18 will measure a larger vibration than accelerometer 20. Through testing, theoretical maximum and minimum vibrations can be pre-programmed into the memory. This data may be customized to the particular golfer by factoring in the golfer's typical or measured swing speed, as greater swing speeds create greater force, acceleration, and vibration values. By comparing the measured value of a particular swing to the data stored in the memory, the golfer's performance can be quantified and displayed on the screen, giving the golfer instant feedback regarding the swing.

According to another aspect, the method of the present invention includes swinging the golf club of the present invention. Initially, the club is positioned near the golf ball as a golfer lines up his/her shot, referred to as the initial position. The club goes through three stages with respect to the initial position, commonly referred to as the backswing, the downswing, and the follow-through. During the backswing and downswing, the accelerometer measures the acceleration of the golf club head. Subsequent to impact, i.e., during the follow-through, the accelerometer measures the deceleration of the golf club head. During impact between the golf club head and the golf ball, the velocity of the golf club may be determined. The velocity during impact is determined based on the measured force components, described in detail above. Optionally, the efficiency of the impact may also be determined as described above.

After a golf swing has been completed, the information may be displayed. Preferably, the information is displayed on a screen 22 (FIG. 1) that is configured and dimensioned to be part of the golf club, as described above. In other embodiments, the stored information may be transmitted to another processor that may display the information. The transfer of information may be wired or wireless. The information, e.g., the acceleration, deceleration, and velocity, is preferably displayed numerically. In a more preferred embodiment, however, a graphical illustration of the acceleration in each stage of the swing may be provided. In embodiments where kinematic information is transferred to an external processor, the information may be analyzed and charts, graphs, or other types of analysis may be performed.

For instance, the swing speed of the golf club may be measured and displayed. In addition, the acceleration and velocity of the golf club head may be used to calculate the distance and trajectory of the golf ball. Alternately, the present invention may also be combined with other types of electronic monitoring equipment. For instance, the present invention may be used in combination with external launch monitors that measure the kinematic characteristics of both the golf club and the golf ball. The information obtained by the launch monitor may be combined with the kinematic information measured by the present invention in order to measure and display swing speed, ball trajectory and distance, and ball spin. Examples of launch monitors that may be used in combination with the present invention include U.S. patent Ser. Nos. 10/861,443 and 10/898,367, the entireties of which are incorporated herein by reference. The present invention may also be used in combination with other methods and apparatus for measuring the kinematics of both golf equipment and a golfer's body. Examples of such methods and apparatus are disclosed in U.S. patent Ser. Nos. 11/364,343 and 11/524,304, the entireties of which are also incorporated herein by reference.

Although the present invention has been described with reference to particular embodiments, it will be understood to those skilled in the art that the invention is capable of a variety of alternative embodiments within the spirit of the appended claims. For example, while the inventive aspects have been described above mainly in conjunction with a hollow golf club, the invention may also take the form of a solid golf club such as an iron-type golf club. Moreover, not all disclosed aspects need to be included in any single embodiment. Further, directional references disclosed herein are with respect to the club head at the address position and are only illustrative in nature.

What is claimed is:

1. An apparatus, comprising:

a golf club head comprising a face and a rear;

a piezoelectric component selectively positioned rearward of a center of gravity of the golf club head and substantially aligned with a midpoint of the face of the golf club head; and a display operatively connected to the piezoelectric component and configured and dimensioned to be included as part of a surface of the golf club head.

2. The apparatus of claim 1, wherein the golf club head comprises an inner volume bounded by the face and the rear, and the piezoelectric component is coupled to the club head within the inner volume.

3. The apparatus according to claim 1, wherein the piezoelectric device comprises an accelerometer.

4. The apparatus of claim 1, further comprising a processor and a memory operatively connected to the piezoelectric component.

5. The apparatus of claim 1, further comprising a wireless transmitter.

6. The apparatus of claim 1, wherein the piezoelectric component is secured in a desired portion of the inner volume of the club head by a fastener.

7. The apparatus of claim 1, wherein the piezoelectric component is operable to determine a velocity of the golf club head at impact with an object.

8. The apparatus of claim 1, wherein the piezoelectric component is operable to determine a magnitude of vibration generated during impact with an object.

9. The apparatus of claim 1, wherein the piezoelectric component is operable to measure an acceleration and a deceleration of the golf club head.

10. The method of claim 1, wherein the piezoelectric component measures the linear and rotational acceleration and deceleration of the golf club head.

11. An apparatus for measuring the kinematics of a golf club head, comprising:

a golf club head defining an inner volume and having a face and a rear; and at least two piezoelectric components selectively positioned within the inner volume of the golf club head;

wherein the at least two piezoelectric components are positioned towards the rear of the golf club head and a first of the at least two piezoelectric components is positioned between a heel and a midpoint of the face of the golf club head and a second of the at least two piezoelectric components is positioned between a toe and the midpoint of the face;

and wherein the at least two piezoelectric components are positioned rearward of a center of gravity of the club head.

12. The apparatus of claim 11, further comprising a memory and a processor operatively connected to at least one of the at least two piezoelectric components.

13. The apparatus of claim 11, further comprising a display operatively connected to at least one of the at least two piezoelectric components, wherein the display is configured and dimensioned to be a part of a surface of the golf club head.

14. The apparatus of claim 11, further comprising a wireless transmitter.

15. A method for measuring the kinematic characteristics of a golf club swing, comprising:

selectively connecting at least one accelerometer to a golf club head;

acquiring the kinematic characteristics of the golf club head during the golf club swing using the accelerometer; and displaying the kinematic characteristics of the golf club head;

wherein the at least one accelerometer is selectively positioned rearward of a center of gravity of the club head and between a heel and a midpoint of a face of the club head.

16. The method of claim 15, further comprising determining a velocity of the club head during impact with an object.

17. The method of claim 15, further comprising determining the acceleration and deceleration of the golf club head during a golf swing.

18. The method of claim 15, further comprising determining a magnitude of vibration during impact with an object.

19. The method of claim 15, further comprising comparing measured data with data stored in a memory to calculate an efficiency of the golf club swing.

20. The method of claim 19, further comprising displaying the efficiency of the golf club swing.

* * * * *